US011760451B1

(12) United States Patent
Solotoff

(10) Patent No.: US 11,760,451 B1
(45) Date of Patent: Sep. 19, 2023

(54) FULL FACE DIVING MASK WITH BREATHING TUBE AND STILL PHOTO AND VIDEO IMAGING CAPABILITY

(71) Applicant: PREFERRED PRESCRIPTION, INC., Hollywood, FL (US)

(72) Inventor: Brandon Solotoff, Boca Raton, FL (US)

(73) Assignee: Preferred Industries, Inc., Hollywood, FL (US)

( * ) Notice: Subject to any disclaimer, the term of this patent is extended or adjusted under 35 U.S.C. 154(b) by 170 days.

(21) Appl. No.: 16/997,111

(22) Filed: Aug. 19, 2020

Related U.S. Application Data

(60) Provisional application No. 62/890,126, filed on Aug. 22, 2019.

(51) Int. Cl.
*B63C 11/16* (2006.01)
*B63C 11/12* (2006.01)

(52) U.S. Cl.
CPC ..... *B63C 11/12* (2013.01); *B63C 11/16* (2013.01); *B63C 2011/121* (2013.01); *B63C 2011/123* (2013.01); *B63C 2011/128* (2013.01)

(58) Field of Classification Search
CPC ... B63C 11/12; B63C 11/16; B63C 2011/121; B63C 2011/128; B63C 2011/165; B63C 2011/123
(Continued)

(56) References Cited

U.S. PATENT DOCUMENTS 3,892,234 A 7/1975 Jones
4,797,736 A 1/1989 Kloots
(Continued)

FOREIGN PATENT DOCUMENTS

CA 2762400 A1 * 6/2013 ..... A61F 9/029
CN 204742947 U * 11/2015 ..... B63C 11/12
(Continued)

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Frederick L Lagman
(74) *Attorney, Agent, or Firm* — Thomas A. O'Rourke; James Bongiorno

(57) ABSTRACT

A dive mask provides underwater images and includes: a transparent lens; a frame; a strap arrangement; a water-proof housing; a camera; and batteries. A first portion of the frame receives the transparent lens, and a second portion mounts to a wearer's face. The strap arrangement secures the frame to the wearer's head. The water-proof housing is secured within the frame, with a least a portion thereof being sealed against a portion of the transparent lens. The camera is positioned within the water proof enclosure, and include a shutter button that may be depressed to capture still images or video recordings. The batteries are positioned in the water-proof housing and power the camera. A water proof port permits recharging of the batteries. A waterproof pouch with a re-sealable waterproof closure is releasably secured to one strap using a lanyard, and stores the user's personal belongings while diving.

11 Claims, 7 Drawing Sheets

(58) Field of Classification Search
USPC ..... 405/185, 186
See application file for complete search history.

(56) References Cited

U.S. PATENT DOCUMENTS

| | | | | |
|---|---|---|---|---|
| 5,583,571 | A | 12/1996 | Friedland | |
| 5,645,205 | A * | 7/1997 | Kennedy | A45C 11/22 224/667 |
| 5,767,932 | A * | 6/1998 | Gordon | B63C 11/12 351/158 |
| 5,886,739 | A | 3/1999 | Winningstad | |
| 6,181,644 | B1 | 1/2001 | Gallagher | |
| 6,390,640 | B1 * | 5/2002 | Wong | B63C 11/12 362/184 |
| 6,549,231 | B1 | 4/2003 | Matsui | |
| 6,717,737 | B1 * | 4/2004 | Haglund | G11B 33/025 348/E7.087 |
| 6,977,671 | B1 | 12/2005 | Kitson | |
| 7,576,800 | B2 | 8/2009 | Swain | |
| 7,806,525 | B2 | 10/2010 | Howell | |
| 8,310,555 | B2 * | 11/2012 | Ludlow | A61F 9/029 348/151 |
| 8,692,886 | B2 | 4/2014 | Ennis | |
| 8,730,388 | B2 | 5/2014 | Osborn | |
| 9,077,877 | B2 | 7/2015 | Fountain | |
| D736,302 | S | 8/2015 | Yu | |
| 9,504,876 | B2 | 11/2016 | Lo | |
| 9,609,902 | B2 | 4/2017 | Waters | |
| 10,137,969 | B2 | 11/2018 | Lin | |
| 2003/0115010 | A1 * | 6/2003 | Estep | B63C 11/12 702/127 |
| 2005/0237386 | A1 | 10/2005 | Sandos | |
| 2008/0013110 | A1 | 6/2008 | Bruce | |
| 2008/0019211 | A1 | 8/2008 | Pearson | |
| 2008/0192114 | A1 * | 8/2008 | Pearson | B63C 11/12 396/25 |
| 2014/0270685 | A1 | 9/2014 | Letke | |
| 2015/0009309 | A1 | 1/2015 | Heinrick | |
| 2015/0358515 | A1 | 12/2015 | Resnick | |
| 2016/0127716 | A1 * | 5/2016 | Ramiro | B63C 11/12 348/53 |
| 2016/0297505 | A1 * | 10/2016 | Caprice | B63C 11/16 |
| 2017/0096204 | A1 * | 4/2017 | Cucchia | B63C 11/16 |
| 2018/0308222 | A1 * | 10/2018 | Wade | G06F 3/147 |
| 2019/0359302 | A1 * | 11/2019 | Shiue | G03B 17/08 |
| 2021/0009247 | A1 * | 1/2021 | Seilliere | B63C 11/12 |

FOREIGN PATENT DOCUMENTS

| | | | | |
|---|---|---|---|---|
| FR | 3079205 | A1 * | 9/2019 | B63C 11/12 |
| GB | 2444105 | A * | 5/2008 | G02B 27/017 |
| GB | 2498753 | A * | 7/2013 | B63C 11/16 |
| KR | 101317314 | B1 | 5/2012 | |

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.

"Engineering Fit," available at: https://en.wikipedia.org/wiki/Engineering_fit, Jul. 8, 2019.

* cited by examiner

FULL FACE DIVING MASK WITH BREATHING TUBE AND STILL PHOTO AND VIDEO IMAGING CAPABILITY

CROSS REFERENCES TO RELATED APPLICATIONS

This application claims priority on U.S. Provisional Application Ser. No. 62/890,126, filed on Aug. 22, 2019, the disclosures of which are incorporated herein by reference.

FIELD OF THE INVENTION

The subject technology relates generally to face masks and breathing tubes for snorkeling, and more particularly to a full face mask with a snorkel, which mask includes a camera to acquire still images and video of underwater attractions.

BACKGROUND OF THE INVENTION

Snorkeling is the swimming by an individual near the surface of the water with their face disposed downward to observe the underwater scene, with at least a portion of the face being covered by a mask to protect their eyes from the water, while breathing through a tube having an end disposed above the surface of the water body.

A typical beginning experience involves passive snorkeling, where the participant remains at the surface as just described. However, more advanced snorkelers employ a method known as duck diving. With the duck diving technique the person dives downward to be submerged below the surface, permitting a closer look at undersea creatures and natural formations in what is also referred to as active snorkeling. The technique emulates the duck's water diving technique where the bird dives head first downward into a vertical position to hunt for food. Advanced snorkelers also return to the surface and clear the water out of the breathing tube with timed exhalation and rotation of the end of the tube above the surface as it is reached.

Passive and active snorkeling each can provide amazing views of the undersea world that may be cherished by the individual, which may prompt the person to carry a camera to photograph the visual experience. But the holding and carrying of a camera in the hands of the diver tends to diminish the experience, and he/she may no longer be able to maneuver as deftly underwater without free use of their hands, or may not even be able to perform active diving at all.

A partial face mask that covers the eyes and nose, and a full face mask that covers the mouth as well, for snorkeling and other underwater activities are known in the art. (See e.g., U.S. Pat. No. 1,324,727 to Runyan; U.S. Pat. No. 4,029,092 to Morgan; U.S. Pat. No. 4,856,120 to Hart; U.S. Pat. No. 5,199,421 to Figgiani; and U.S. Pat. No. 5,586,466 to Kuo).

The apparatus disclosed herein incorporates additional functionality into a diving/snorkeling face mask of either type, which functionality includes, but is not limited to, a camera for recording and downloading of still photos and/or video images.

It is noted that citing herein of any patents, published patent applications, and non-patent literature is not an admission as to any of those references constituting prior art with respect to the disclosed apparatus.

OBJECTS OF THE INVENTION

It is an object of the invention to provide a face mask that may be used for snorkeling and/or underwater diving.

It is another object of the invention to provide a face mask that may cover each of the eyes, nose, and mouth of the wearer for use in snorkeling and/or underwater diving.

It is a further object of the invention to provide a face mask for use in snorkeling and/or underwater diving, and which is also configured to capture still photographic images.

It is another object of the invention to provide a face mask for use in snorkeling and/or underwater diving, and which is also configured to capture video images.

It is also an object of the invention to provide a face mask for use in snorkeling and/or underwater diving, and which has a built-in camera to capture hands-free underwater images.

Further objects and advantages of the invention will become apparent from the following description and claims, and from the accompanying drawings.

BRIEF DESCRIPTION OF THE DRAWINGS

The description of the various example embodiments is explained in conjunction with appended drawings, in which.

SUMMARY OF THE INVENTION

Figure 1:
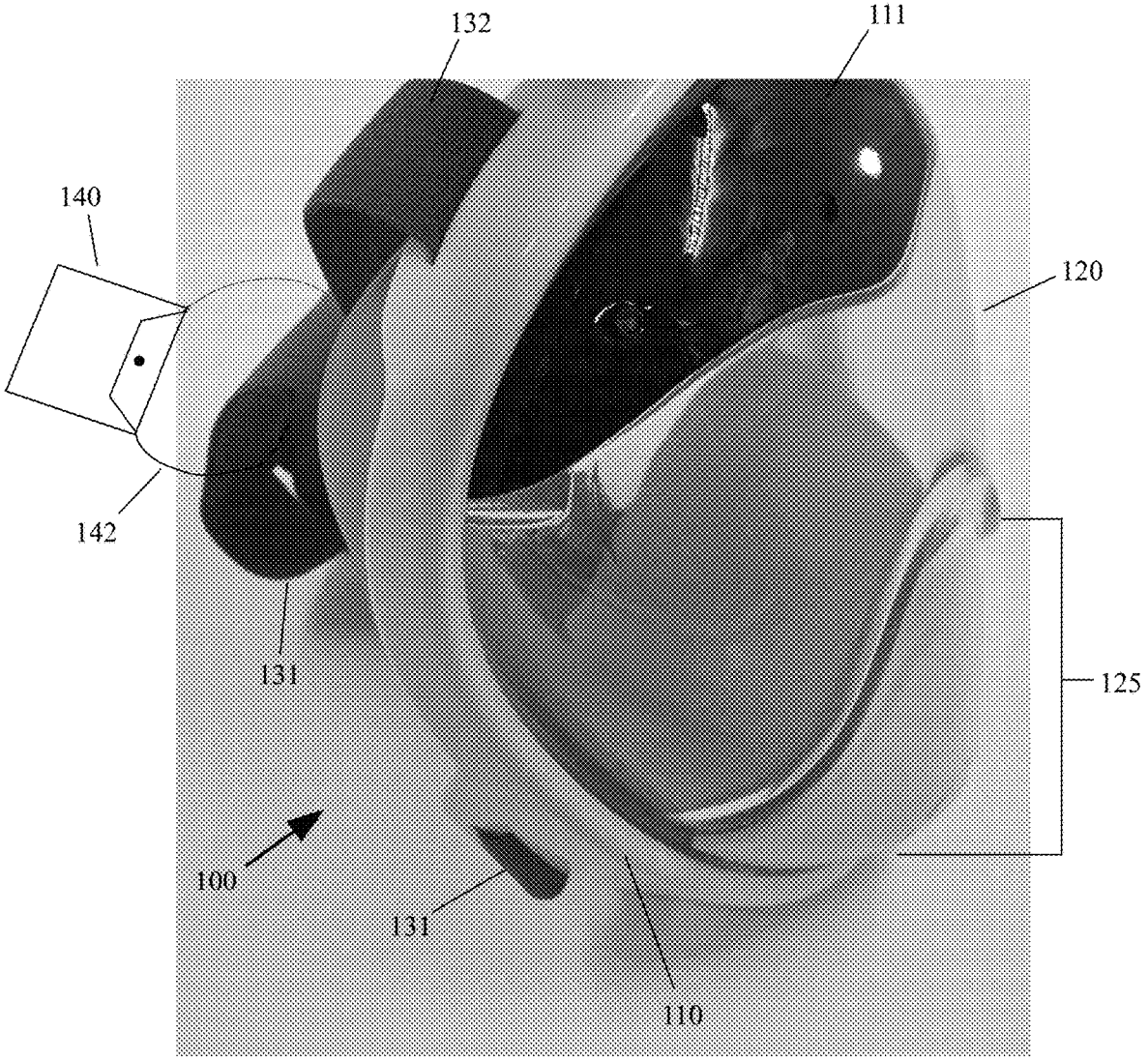
FIG. 1 illustrates a side perspective view of the face mask with snorkel and image capture capability disclosed herein, showing the left side of the mask.
Figure 2:
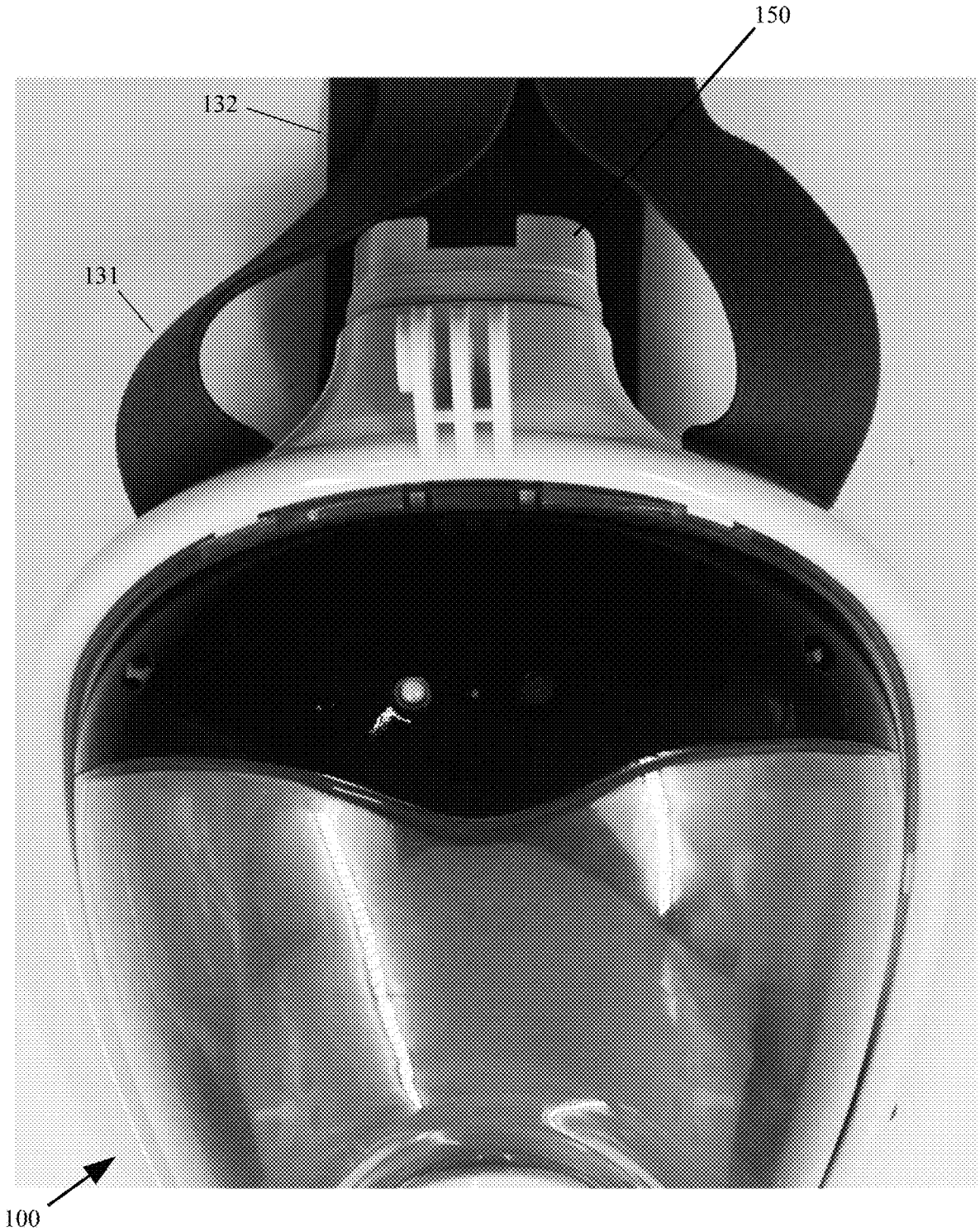
FIG. 2 is a top view of the face mask of FIG. 1.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the disclosed apparatus, a dive mask configured to provide select underwater images may include: a transparent lens; a frame; a strap arrangement; a water-proof housing; a camera; and one or more batteries. A first portion of the frame is configured to receive the transparent lens, and a second portion of the frame is configured to mount to a wearer's face. The strap arrangement is configured to secure the frame to the wearer's head, and includes: a first strap portion having a first end secured to a first side of the frame and a second end secured to a second side of the frame; and a second strap portion having a first end secured to an upper portion of the frame, and a second end coupled to a central portion of the first strap portion. The first strap portion and the second strap portion cooperate to secure the dive mask to the wearer's face. The water-proof housing is secured within the frame, with a least a portion of the water proof housing sealed against a portion of the transparent lens. The camera is positioned within the water proof enclosure, and include a shutter button that may be depressed by the user's hand outside of the frame. The camera is configured to repetitively capture still images through the transparent lens by repeated depressing of the shutter button. Also, the camera is configured to capture a video recording by depressing of the shutter button for a threshold period of time, and to cease capturing video upon subsequent depressing of the shutter button. One or more rechargeable batteries are positioned in the water-proof housing and thereat power the camera. A water proof port permits recharging of the one or more batteries.

The dive mask may also have: an indicator light configured to light up to indicate to others in the vicinity of the user that the video recording is being captured; an indicator light configured to light up to indicate to the user that the video recording in being captured; and also a light configured to illuminate an area surrounding the dive mask when in dark or murky water.

The dive mask may also have: a waterproof pouch with a re-sealable waterproof closure that may be releasably secured to one of the straps of the strap arrangement using a lanyard. The waterproof pouch may be used to secured store the user's personal belonging while diving, such has his/her keys, wallet, cell phone, etc.

DETAILED DESCRIPTION OF THE INVENTION

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed apparatus.

Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of .0001 inches to .0003 inches, or an interference of .0003 inches to .0007 inches in another embodiment, or an interference of .0007 inches to .0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit (e.g., for a 0.1250 inch shaft diameter the opening may be 0.1285 inches for a close fit and may be 0.1360 inches for a free (running) fit; and for a 0.5000 inch diameter shaft size the opening may be 0.5156 inches for a close clearance fit and may be 0.5312 inches for a free clearance fit). Other clearance amounts may also be used.

As used herein, the term "waterproof" indicates that unless opened, broken, cracked, etc., the item is substantially impervious to water inadvertently entering the interior housing area of the face mask, during normal use. This term does not encompass any fluid substance which may be specifically added, or desirably added into the interior of the item (e.g., a lubricant).

As seen in FIG. 1, a first embodiment may be a face mask 100 that may broadly include a circumferential rim/frame 110, a transparent lens 120, a strap arrangement, and at least one breathing tube 150 extending away from the mask. The circumferential rim/frame 110 may be generally flexible in one embodiment, and may be substantially rigid in another embodiment, and may have at least a portion coated with a soft pliable material configured for sealing of the face mask 100 with respect to the facial features of the wearer (e.g., the forehead, the cheeks, the upper lip, and possibly the chin of the wearer). Therefore the circumferential rim 110 as formed may be shaped to fit against and enclose the eyes, the nose, the mouth, and lateral portions of the wearer's face to keep out water while snorkeling.

In one embodiment of the face mask 100, the transparent lens 120 may be formed to extend into contact with and be supported by the entire periphery of the circumferential rim/frame 110. In another embodiment, as seen in the figures, the face mask 100 may be partitioned to include a lower chamber 125, and the transparent lens 120 may be formed to extend into contact with and be supported by the upper portion of the periphery of the circumferential rim/frame 110 and may be joined to the periphery of the structure that forms the lower chamber.

In one embodiment of the face mask 100, the lower chamber 125 may have a diaphragm 126 therein having a portion exposed to the interior of the mask 100 and a portion exposed to the surrounding environment, and which diaphragm may enhance transmission of any words spoken to nearby persons by the snorkeler wearing the mask. In another embodiment, the lower chamber 125 may additionally or alternatively have a purge valve 127 that is configured to flex outwardly to permit air flow from the interior of the mask to the exterior of the mask upon exhalation by the diver through his/her nose or mouth, and which valve also prevents the flow of water into the mask 100.

Figure 3:
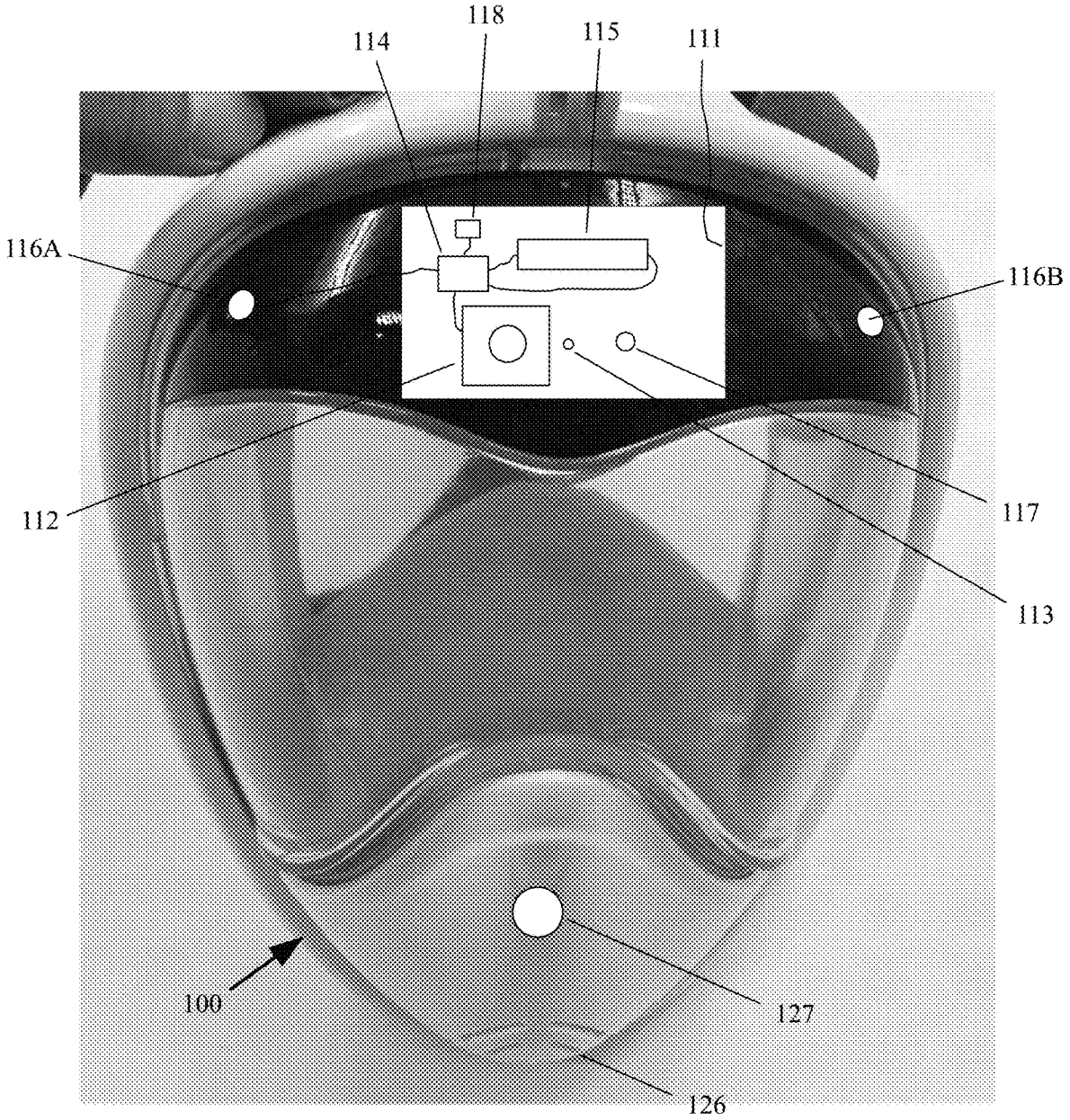
FIG. 3 is the top view of FIG. 2, with the upper portion of the mask shown enlarged.
Figure 4:
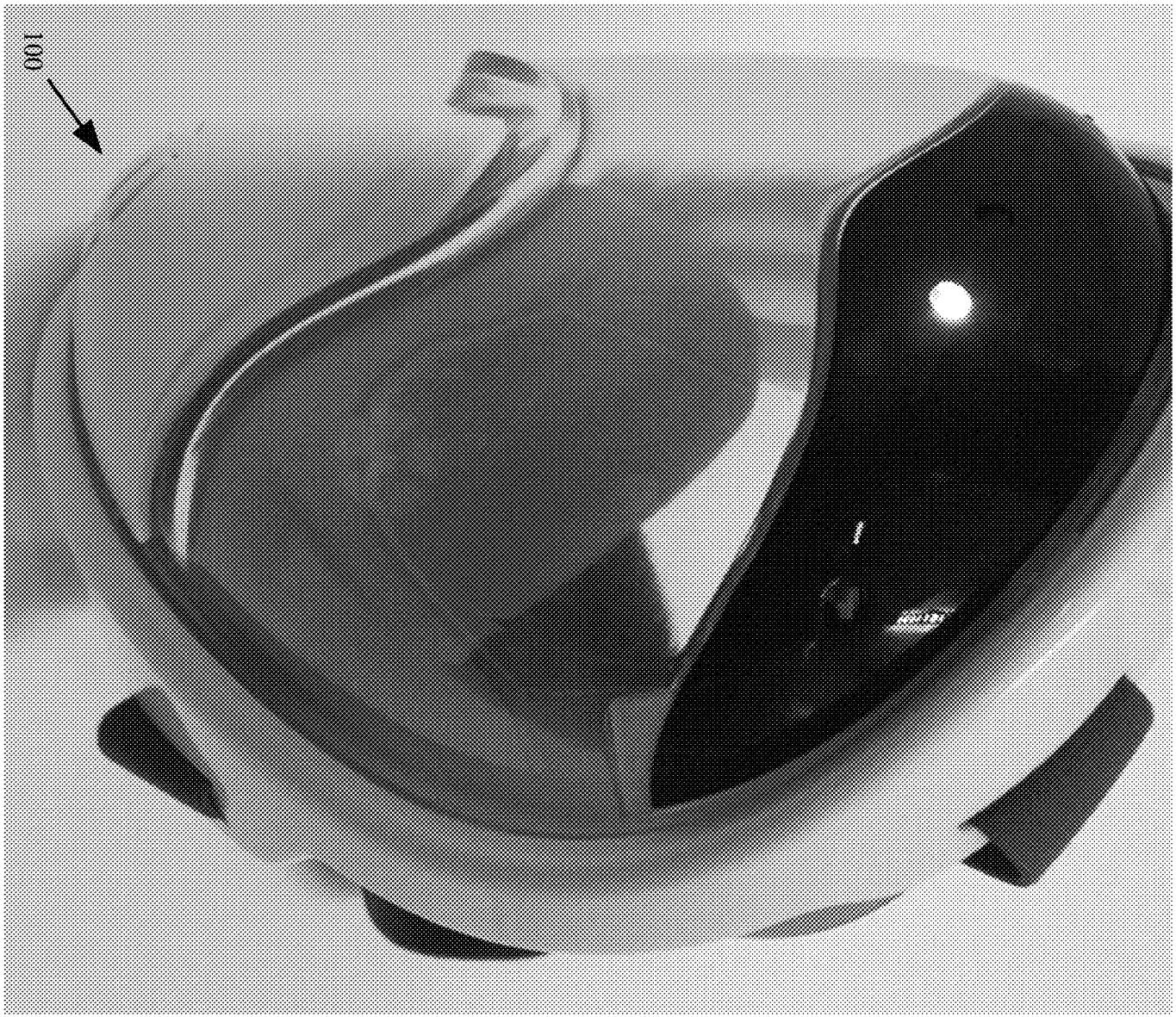
FIG. 4 illustrates another view of the top of the mask of FIG. 1.
Figure 5:
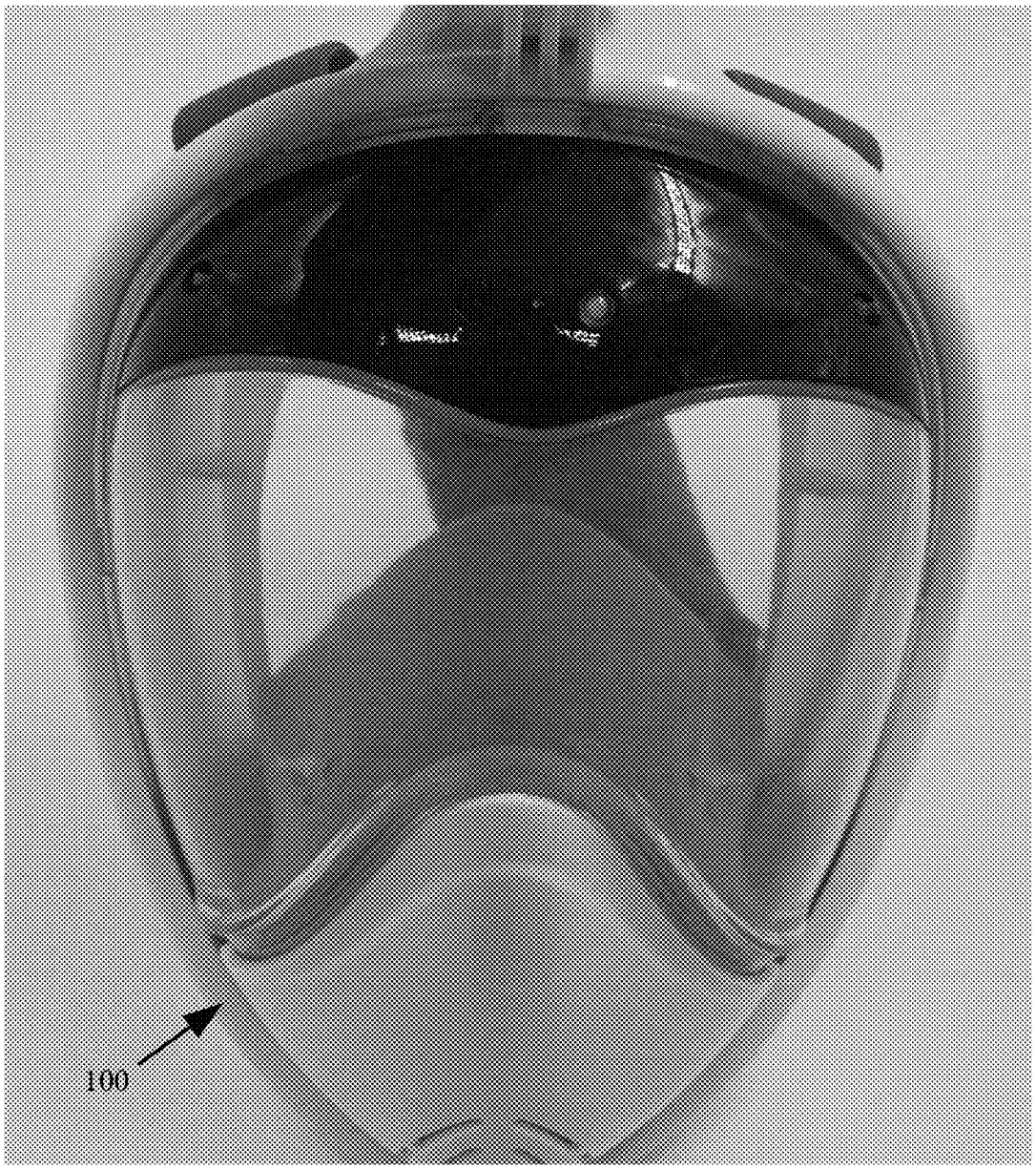
FIG. 5 illustrates yet another view of the top of the mask of FIG. 1.
Figure 6:
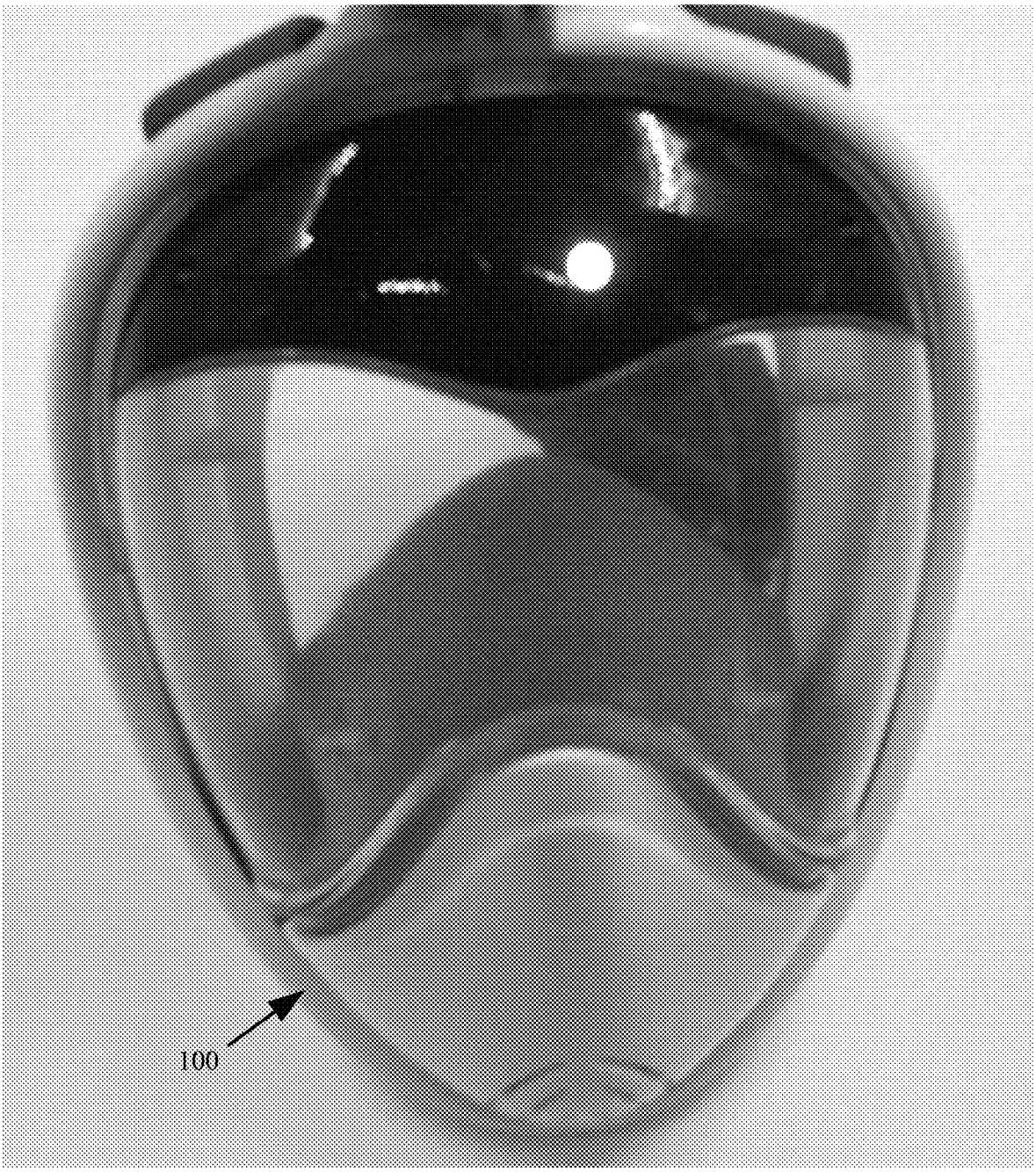
FIG. 6 is a side perspective view of the face mask shown to FIG. 1, but showing the left side of the mask.
Figure 7:
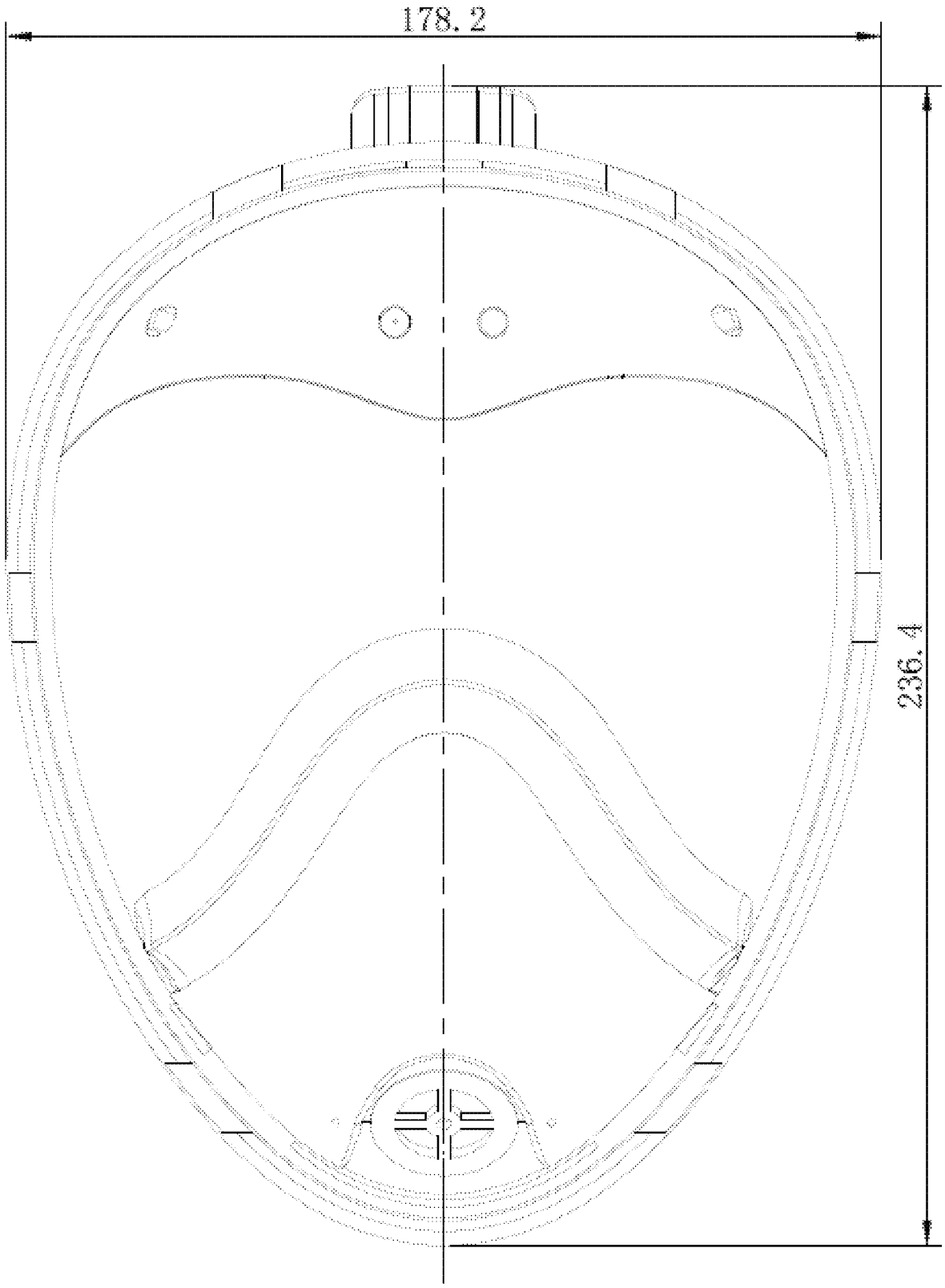
FIG. 7 illustrates another view of the top of the mask of FIG. 1.

The upper portion of the mask 100 may have a housing 111 integrally formed with, or fixedly secured to, the circumferential rim/frame 110 and/or a portion of the transparent lens 120. In one embodiment the housing 111 may be formed to be flush against a portion of the transparent lens 120 and may be sealed with respect to the lens, and may furthermore provide a waterproof enclosure for the components housed therein. The housing 111 may be formed to house a plurality of components, including necessary electronic circuity and a PCB 114 to support the components. The housing 111 may house a camera 112 (see FIG. 3), an indicator light/LED 113 that may indicate that the unit is operating, and one or more rechargeable batteries 115 configured to provide power to each of the electrical components, including the camera. The camera 112 may be configured to repetitively capture still images by repeated depressing of the button 116A in the same manner that a shutter release button is toggled on the typical SLR camera or digital camera. Depressing of the button 116A and maintaining it in the depressed position for a short threshold period of time (e.g., 2-3 seconds) may cause the camera 112 to begin making a video recording, rather than capturing a still image, and subsequently depressing of the button 116A may cause the camera to cease capturing the video images. While the camera is recoding video images, the indicator light/LED 113 may be powered to light up to indicate to others in the vicinity of the snorkeler that such a recording in taking place. Another such light (not shown) may be positioned on the inside of the mask 100, so that it may be visible to its wearer, to provide a positive indication to the snorkeler that the camera is still operating to record video images, which may also thereby provide indication to the snorkeler as to the battery not yet having been depleted. The camera 112 and battery arrangement is configured to permit recording of 360 minutes of continuous video. The housing may also include a light 117 that may illuminate the nearby area for use in situations where the water may be too dark or murky to accomplish satisfactory video recording, which light may be turned on or off by a switch button 116B. A water proof port 118 may be coupled to the electronics to permit recharging of the battery, as well as removal/downloading of the photographic data.

The strap arrangement may include a first strap portion 131 that may be secured to and may extend from a first side of the circumferential rim/frame 110 of the mask 100 to another side of the frame. In addition, a second strap portion 132 may have a first end secured to an upper portion of the circumferential rim/frame 110 and may have a second end coupled to a central portion of the first strap portion 131. Both the first strap portion 131 and the second strap portion 132 may cooperate to secure the mask 100 to the wearer's face.

As seen in FIG. 1, a pouch 140 may be fixedly secured or may be releasably secured (e.g., using a lanyard 142 or a D-ring, or any other suitable releasable coupling apparatus) to one of the strap portions 131/132 to provide storage for the person's belonging (e.g., keys, a cell phone, etc.), so that nothing important need be left behind on a beach while snorkeling. To accommodate storage therein of a cell phone, a watch, or other electronic devices, the pouch may be formed of a waterproof material (e.g., plastic) and have a re-sealable waterproof closure. The re-sealable waterproof closure may include, but is not limited to, the closures shown by the following: U.S. Pat. No. 4,892,414 to Ausnit; U.S. Pat. No. 8,376,614 to Pawloski; U.S. Pat. No. 7,029,178 to Gzybowski; and U.S. Patent App. Pub. No. 2009/0053445 by Trent. Also, as to forming the pouch, see U.S. Pat. No.: 1,559,270 to Miller; U.S. Pat. No. 5,114,061 to Brady; and U.S. Pat. No. 6,435,392 to Kennedy.

While illustrative implementations of one or more embodiments of the disclosed apparatus are provided hereinabove, those skilled in the art and having the benefit of the present disclosure will appreciate that further embodiments may be implemented with various changes within the scope of the disclosed apparatus. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A dive mask configured to provide select underwater images, said dive mask comprising:

a transparent lens;

a frame, a first portion of said frame configured to receive and support said transparent lens, and a second portion of said frame configured to mount to and seal against a wearer's face;

a strap arrangement, said strap arrangement configured to secure said frame to the wearer's head;

a water-proof housing, said water proof housing secured within said frame, with a least a portion of said water proof housing sealed against a portion of said transparent lens;

a camera; said camera positioned within said water proof enclosure; said camera comprising a shutter button configured to be depressed from outside of said frame;

wherein said camera is configured to repetitively capture a still image through said transparent lens when said shutter button is depressed for a first threshold period of time; and wherein said camera is configured to capture a video recording through said transparent lens when said shutter button is depressed for a second threshold period of time, and is further configured to cease capturing the video recording upon a subsequent depressing of said shutter button, said second threshold period of time being greater than said first threshold period of time; and wherein said camera is configured to be powered by one or more rechargeable batteries.

2. The dive mask according to claim 1, further comprising:

a waterproof pouch with an integrally formed re-sealable waterproof closure;

a lanyard, said lanyard configured to releasably secure said waterproof pouch to one of said straps of said strap arrangement.

3. The dive mask according to claim 1, further comprising: a water proof port configured to permit recharging of said one or more batteries.

4. The dive mask according to claim 3, wherein said strap arrangement comprises:

a first strap portion, said first strap portion having a first end secured to a first side of said frame and a second end secured to a second side of said frame;

a second strap portion, said second strap having a first end secured to an upper portion of said frame, and a second end coupled to a central portion of said first strap portion; and wherein said first strap portion and said second strap portion cooperate to secure said dive mask to the wearer's face.

5. The dive mask according to claim 3, further comprising: a first indicator light, said first indicator light configured to light up to indicate to others in the vicinity of the user that the video recording is being captured; and wherein said first indicator light is positioned on an outside surface of said dive mask.

6. The dive mask according to claim 5, further comprising: a second indicator light, said second indicator light configured to light up to indicate to the user that the video recording is being captured; and wherein said second indicator light is positioned on an inside surface of said dive mask, being positioned on said inside surface of said dive mask to be visible to the wearer.

7. The dive mask according to claim 6, further comprising: a third indicator light, said third indicator light configured to light up to indicate to the user that the one or more rechargeable batteries are not depleted.

8. The dive mask according to claim 7, further comprising: a fourth indicator light, said fourth indicator light positioned on an outside surface of said dive mask, and is configured to illuminate an area surrounding said dive mask when in dark or murky water; and wherein said fourth indicator light is configured to be turned on or off by a separate switch button.

9. The dive mask according to claim 8, further comprising:

a waterproof pouch with a re-sealable waterproof closure;

means for releasably securing said waterproof pouch to one of said straps of said strap arrangement.

10. The dive mask according to claim 9, wherein said dive mask comprises a lower chamber;

wherein said lower chamber comprises:

a diaphragm, said diaphragm having a portion exposed to an interior of said frame and a portion exposed to the surrounding environment, said diaphragm configured to enhance transmission of words spoken to nearby persons by the wearer of said dive mask; and a purge valve, said purge valve configured to flex outwardly to permit air flow from the interior of the mask to the surrounding environment upon exhalation by the diver through his/her nose or mouth, and said purge valve also configured to prevent water from flowing into the interior of said mask.

11. A dive mask configured to provide select underwater images, said dive mask comprising:

a transparent lens;

a frame, a first portion of said frame configured to receive and support said transparent lens, and a second portion of said frame configured to mount to and seal against a wearer's face;

a strap arrangement, said strap arrangement configured to secure said frame to the wearer's head, wherein said strap arrangement comprises:

a first strap portion, said first strap portion having a first end secured to a first side of said frame and a second end secured to a second side of said frame;

a second strap portion, said second strap having a first end secured to an upper portion of said frame, and a second end coupled to a central portion of said first strap portion; and wherein said first strap portion and said second strap portion cooperate to secure said dive mask to the wearer's face;

a water-proof housing, said water-proof housing secured within said frame, with a least a portion of said water proof housing sealed against a portion of said transparent lens;

a camera; said camera positioned within said water-proof enclosure; said camera comprising a shutter button configured to be depressed from outside of said frame;

wherein said camera is configured to repetitively capture a still image through said transparent lens when said shutter button is depressed for a first threshold period of time; and wherein said camera is configured to capture a video recording through said transparent lens when said shutter button is depressed for a second threshold period of time, and is further configured to cease capturing the video recording upon a subsequent depressing of said shutter button, said second threshold period of time being greater than said first threshold period of time;

wherein said camera is configured to be powered by one or more rechargeable batteries;

a water-proof port configured to permit recharging of the one or more batteries;

a first indicator light, said first indicator light configured to light up to indicate to others in the vicinity of the user that the video recording is being captured; wherein said first indicator light is positioned on an outside surface of said dive mask;

a second indicator light, said second indicator light configured to light up to indicate to the user that the video recording is being captured; wherein said second indicator light is positioned on an inside surface of said dive mask, being positioned on said inside surface of said dive mask to be visible to the wearer;

a third indicator light, said third indicator light configured to light up to indicate to the user that the one or more rechargeable batteries are not depleted;

a fourth indicator light, said fourth indicator light positioned on an outside surface of said dive mask and being configured to illuminate an area surrounding said dive mask when in dark or murky water; wherein said fourth indicator light is configured to be turned on or off by a separate switch button;

a waterproof pouch with an integrally formed re-sealable waterproof closure;

a lanyard, said lanyard configured to releasably secure said waterproof pouch to one of said straps of said strap arrangement;

wherein said dive mask comprises a lower chamber; and wherein said lower chamber comprises:

a diaphragm, said diaphragm having a portion exposed to an interior of said frame and a portion exposed to the surrounding environment, said diaphragm configured to enhance transmission of words spoken to nearby persons by the wearer of said dive mask; and a purge valve, said purge valve configured to flex outwardly to permit air flow from the interior of the mask to the surrounding environment upon exhalation by the diver through his/her nose or mouth, and said purge valve also configured to prevent water from flowing into the interior of said mask.

* * * * *